US010868386B2

(12) United States Patent
Huang

(10) Patent No.: US 10,868,386 B2
(45) Date of Patent: Dec. 15, 2020

(54) CONNECTOR

(71) Applicant: Tyco Electronics (Shanghai) Co. Ltd., Shanghai (CN)

(72) Inventor: Liang Huang, Chengdu (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/233,347

(22) Filed: Dec. 27, 2018

(65) Prior Publication Data

US 2019/0207341 A1 Jul. 4, 2019

(30) Foreign Application Priority Data

Dec. 28, 2017 (CN) ..... 2017 1 1462429

(51) Int. Cl.

| | |
|---|---|
| ***H01R 13/502*** | (2006.01) |
| ***H01R 12/70*** | (2011.01) |
| ***H01R 13/50*** | (2006.01) |
| ***H01R 13/6471*** | (2011.01) |
| ***H01R 4/02*** | (2006.01) |
| ***H01R 12/55*** | (2011.01) |
| *H01R 12/72* | (2011.01) |

(52) U.S. Cl.

CPC ..... *H01R 13/502* (2013.01); *H01R 4/02* (2013.01); *H01R 12/55* (2013.01); *H01R 12/70* (2013.01); *H01R 13/50* (2013.01); *H01R 13/6471* (2013.01); *H01R 12/722* (2013.01)

(58) Field of Classification Search

CPC ..... H01R 13/502; H01R 4/02; H01R 12/55

USPC ..... 439/701

See application file for complete search history.

(56) References Cited

U.S. PATENT DOCUMENTS

| | | | | |
|---|---|---|---|---|
| 5,197,887 A * | 3/1993 | Davidge | H01R 12/721 | 439/60 |
| 5,424,605 A * | 6/1995 | Lovoi | H01J 3/022 | 313/422 |
| 6,617,939 B1 * | 9/2003 | Vermeersch | H01R 13/719 | 333/28 R |
| 6,767,252 B2 * | 7/2004 | McGrath | H05K 1/117 | 439/637 |
| 6,994,563 B2 * | 2/2006 | Amini | H05K 1/117 | 361/777 |
| 7,663,890 B2 * | 2/2010 | Nelson | H05K 3/242 | 361/760 |
| 8,270,180 B2 * | 9/2012 | Liu | H05K 1/0251 | 174/262 |

(Continued)

*Primary Examiner* — Alexander Gilman
(74) *Attorney, Agent, or Firm* — Barley Snyder

(57) ABSTRACT

A connector comprises an insulation body having a plurality of first insulation partition ribs and a row of first contacts arranged on the insulation body at a first pitch. The row of first contacts includes a plurality of first ground contacts and a plurality of first signal contacts. At least two first signal contacts are disposed between two adjacent first ground contacts. Each of the first ground contacts and each of the first signal contacts has a first contact portion, a first fixation portion, and a first elastic arm between the first contact portion and the first fixation portion. Each first insulation partition rib is disposed between the first elastic arm of each first ground contact and the first elastic arm of one first signal contact adjacent to the first ground contact. No insulation rib is disposed between the first elastic arms of any two adjacent first signal contacts.

20 Claims, 5 Drawing Sheets

(56) References Cited

U.S. PATENT DOCUMENTS

| | | | | |
|---|---|---|---|---|
| 8,440,917 | B2 * | 5/2013 | Harvey | H05K 1/0233 174/262 |
| 8,579,662 | B2 * | 11/2013 | Briant | H01R 12/716 439/607.08 |
| 8,614,398 | B2 * | 12/2013 | Regnier | H01R 13/6658 174/261 |
| 8,777,673 | B2 * | 7/2014 | Sun | H01R 12/724 439/660 |
| 9,065,225 | B2 * | 6/2015 | Degner | H01R 12/721 |
| 9,277,649 | B2 * | 3/2016 | Ellison | H01R 12/523 |
| 9,331,421 | B2 * | 5/2016 | Lai | H01R 13/5202 |
| 9,385,477 | B2 * | 7/2016 | De Geest | H01R 13/646 |
| 9,545,003 | B2 * | 1/2017 | Rengarajan | H05K 1/0222 |
| 9,590,353 | B2 * | 3/2017 | Regnier | H01R 24/62 |
| 9,871,325 | B2 * | 1/2018 | Patel | H01R 13/6473 |
| 9,960,553 | B2 * | 5/2018 | Regnier | H01R 12/7005 |
| 10,135,211 | B2 * | 11/2018 | Lloyd | H05K 7/1487 |
| 10,249,988 | B2 * | 4/2019 | Craton | H01R 12/72 |
| 2005/0202722 | A1 * | 9/2005 | Regnier | H05K 1/0222 439/607.05 |
| 2007/0138617 | A1 * | 6/2007 | Knighten | H01L 23/49827 257/698 |
| 2007/0187141 | A1 * | 8/2007 | Bartholomew | H05K 1/029 174/261 |
| 2008/0318478 | A1 * | 12/2008 | Nelson | H05K 1/117 439/620.01 |
| 2009/0211088 | A1 * | 8/2009 | Bartholomew | H05K 1/0219 29/846 |
| 2009/0267183 | A1 * | 10/2009 | Temple | H01L 21/76898 257/532 |
| 2016/0013596 | A1 * | 1/2016 | Regnier | H01R 12/585 439/607.35 |
| 2019/0207327 | A1 * | 7/2019 | Huang | H01R 4/02 |

* cited by examiner

CONNECTOR

CROSS-REFERENCE TO RELATED APPLICATION

This application claims the benefit of the filing date under 35 U.S.C. § 119(a)-(d) of Chinese Patent Application No. 201711462429.2, filed on Dec. 28, 2017.

FIELD OF THE INVENTION

The present invention relates to a connector and, more particularly, to a connector including an insulation body and a row of contacts arranged on the insulation body.

BACKGROUND

An input/output connector (I/O connector) generally includes an insulation body and at least one row of contacts arranged in parallel on the insulation body. Each of the contacts has a fixation portion fixed to the insulation body, a solder foot at an end of the contact, a contact portion at an opposite end of the contact, a connection portion between the fixation portion and the solder foot, and an elastic arm between the fixation portion and the contact portion. The insulation body has a plurality of insulation partition ribs protruding from the insulation body, and the elastic arms of two adjacent contacts are separated by one of the insulation partition ribs.

The elastic arms of the contacts are positioned so as to avoid a short circuit between the elastic arms. However, because the insulation partition rib is disposed between the elastic arms, the width of the contacts and the spacing between adjacent contacts is limited, which restricts the performance of the connector and is particularly disadvantageous for suppressing resonance of the connector.

SUMMARY

A connector comprises an insulation body having a plurality of first insulation partition ribs and a row of first contacts arranged on the insulation body at a first pitch. The row of first contacts includes a plurality of first ground contacts and a plurality of first signal contacts. At least two first signal contacts are disposed between two adjacent first ground contacts. Each of the first ground contacts and each of the first signal contacts has a first contact portion, a first fixation portion, and a first elastic arm between the first contact portion and the first fixation portion. Each first insulation partition rib is disposed between the first elastic arm of each first ground contact and the first elastic arm of one first signal contact adjacent to the first ground contact. No insulation rib is disposed between the first elastic arms of any two adjacent first signal contacts.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
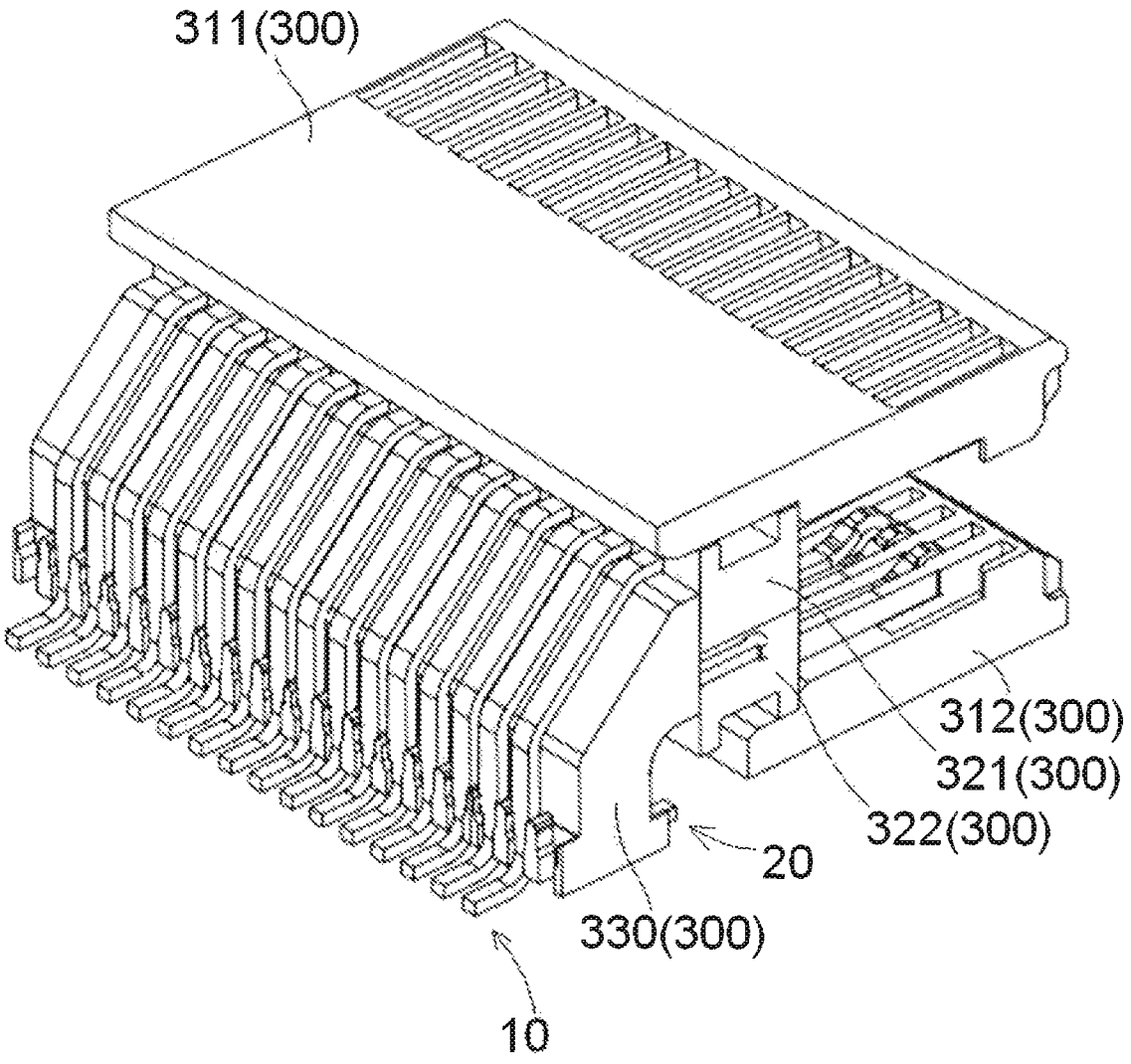
FIG. 1 is a perspective view of a connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
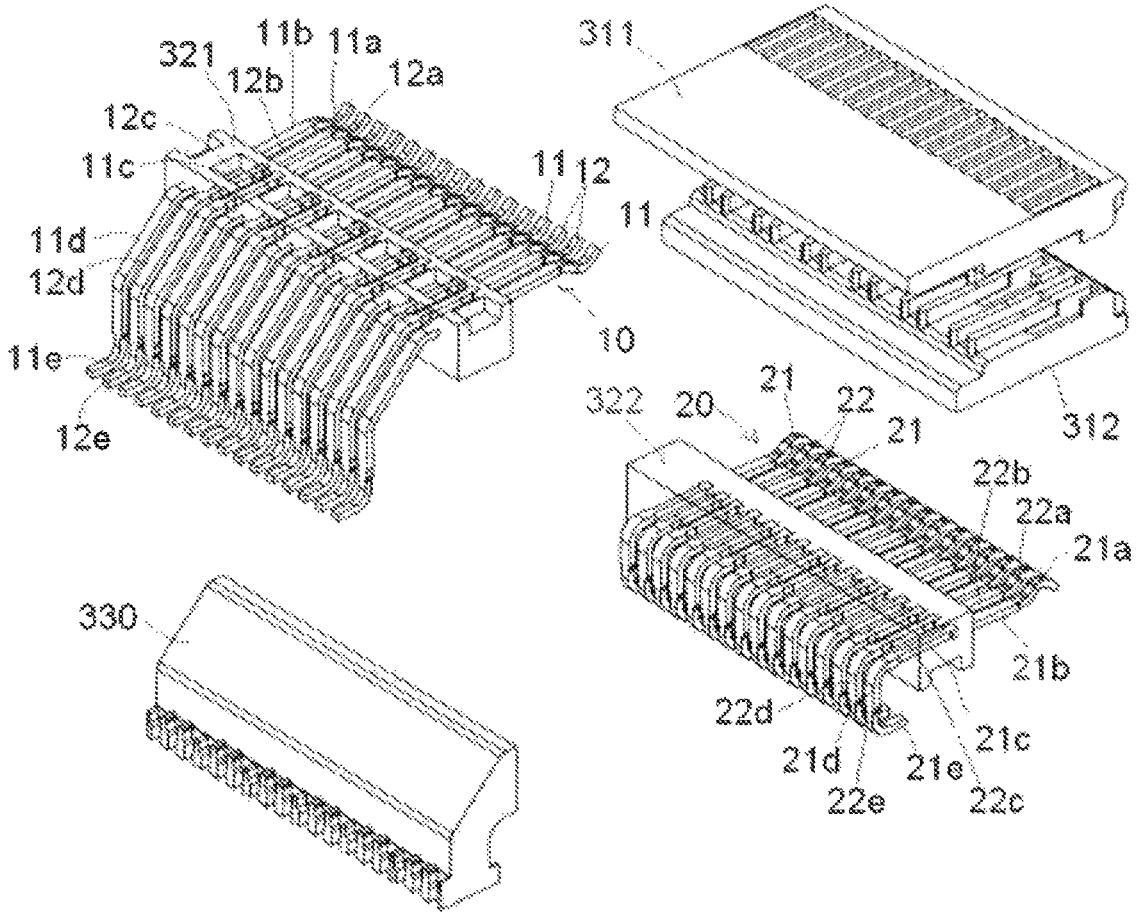
FIG. 2 is an exploded perspective view of the connector.

A connector according to an embodiment, as shown in FIGS. 1 and 2, includes an insulation body 300 and at least one row of contacts 10, 20. The at least one row of contacts 10, 20 are arranged on the insulation body 300 at a pitch. In the shown embodiment, the connector includes a row of first contacts 10 and a row of second contacts 20. In other embodiments, the connector may include one row of contacts or three or more rows of contacts.

As shown in FIGS. 1 and 2, the row of first contacts 10 is arranged on the insulation body 300 at a first pitch. The row of first contacts 10 includes a plurality of first ground contacts 11 and a plurality of first signal contacts 12. At least two first signal contacts 12 are disposed between two adjacent first ground contacts 11. Each of the first ground contacts 11 includes a first contact portion 11*a*, a first fixation portion 11*c*, and a first elastic arm 11*b* between the first contact portion 11*a* and the first fixation portion 11*c*. Each of the first signal contacts 12 includes a first contact portion 12*a*, a first fixation portion 12*c*, and a first elastic arm 12*b* between the first contact portion 12*a* and the first fixation portion 12*c*. In the embodiment shown in FIGS. 2, 3A, and 3B, a pair of first signal contacts 12, 12 are disposed between two adjacent first ground contacts 11. In an embodiment, the pair of first signal contacts 12, 12 are a pair of differential signal contacts.

Figure 3A:
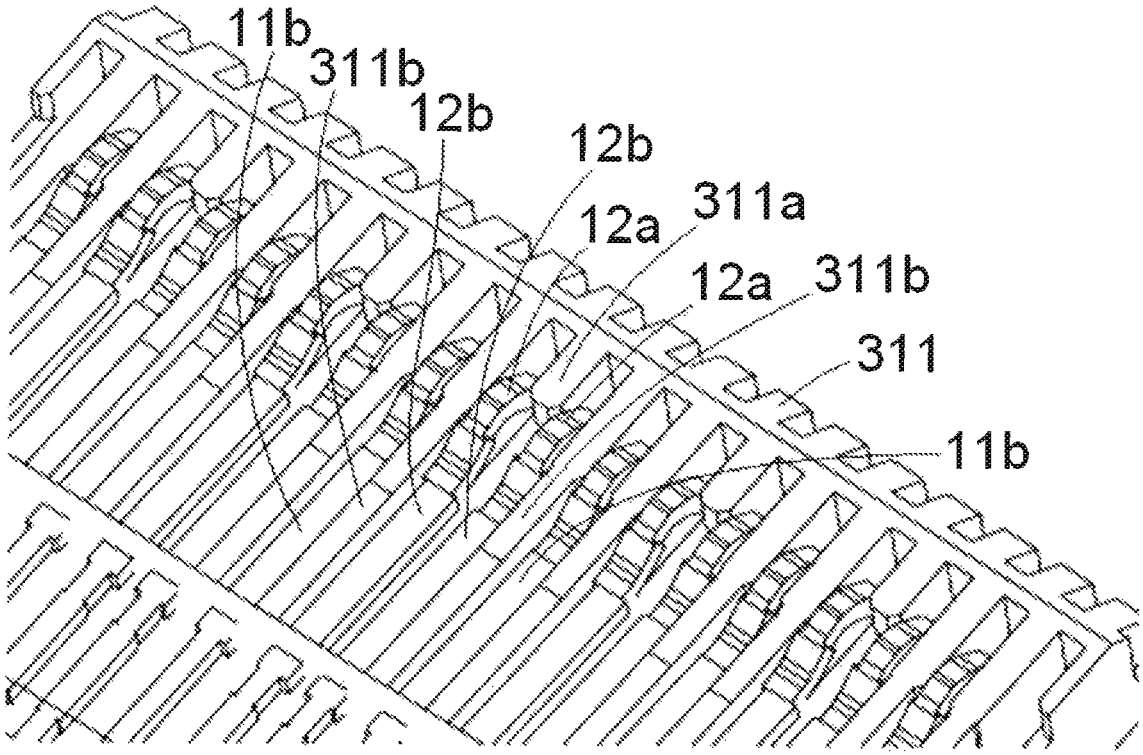
FIG. 3A is a perspective view of a first arm positioning body and a row of first contacts of the connector.
Figure 3B:
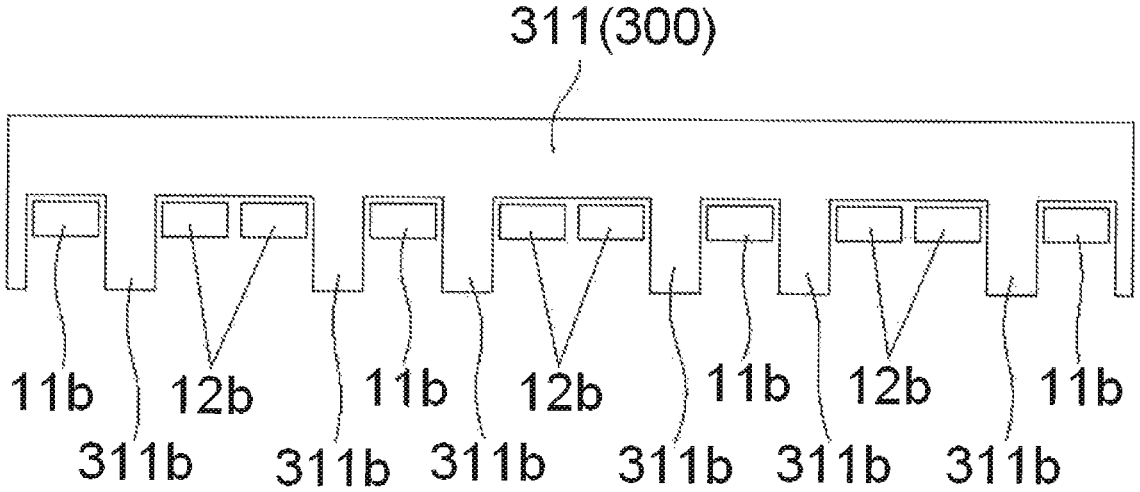
FIG. 3B is a sectional end view of the first arm positioning body and the row of first contacts.

As shown in FIGS. 2, 3A, and 3B, no insulation partition rib is disposed between the first elastic arms 12*b*, 12*b* of any two adjacent first signal contacts 12, 12; the insulation body 300 does not have any insulation partition rib for separating the first elastic arms 12*b*, 12*b* of the adjacent first signal contacts 12, 12. The insulation body 300 has a first insulation partition rib 311*b* disposed between the first elastic arm 11*b* of each first ground contact 11 and the first elastic arm 12*b* of each first signal contact 12 adjacent to the first ground contact 11 so as to separate the first elastic arm 11*b* of the first ground contacts 11 from the first elastic arm 12*b* of the first signal contacts 12 adjacent to the each first ground contact 11.

A row of second contacts 20, as shown in FIGS. 1 and 2, is positioned below the row of first contacts 10 and is arranged on the insulation body 300 at a second pitch. In an embodiment, the second pitch is equal to the first pitch. The row of second contacts 20 includes a plurality of second ground contacts 21 and a plurality of second signal contacts 22. At least two second signal contacts 22 are disposed between two adjacent second ground contacts 21. Each of the second ground contacts 21 includes a second contact portion 21*a*, a second fixation portion 21*c*, and a second elastic arm 21*b* between the second contact portion 21*a* and the second fixation portion 21*c*. Each of the second signal contacts 22 includes a second contact portion 22*a*, a second fixation portion 22*c*, and a second elastic arm 22*b* between the second contact portion 22*a* and the second fixation portion 22*c*. In the embodiment shown in FIGS. 2, 4A, and 4B, a pair of second signal contacts 22, 22 are disposed between two adjacent second ground contacts 21. In an embodiment, the pair of second signal contacts 22, 22 are a pair of differential signal contacts.

Figure 4A:
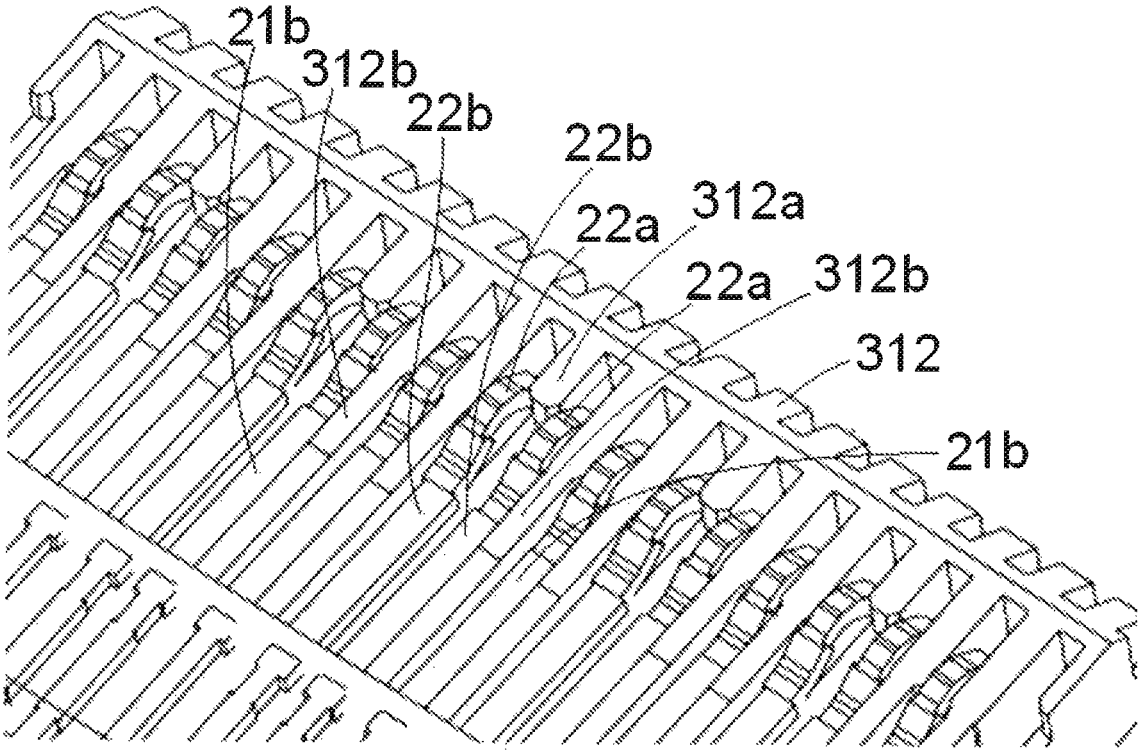
FIG. 4A is a perspective view of a second arm positioning body and a row of second contacts of the connector.
Figure 4B:
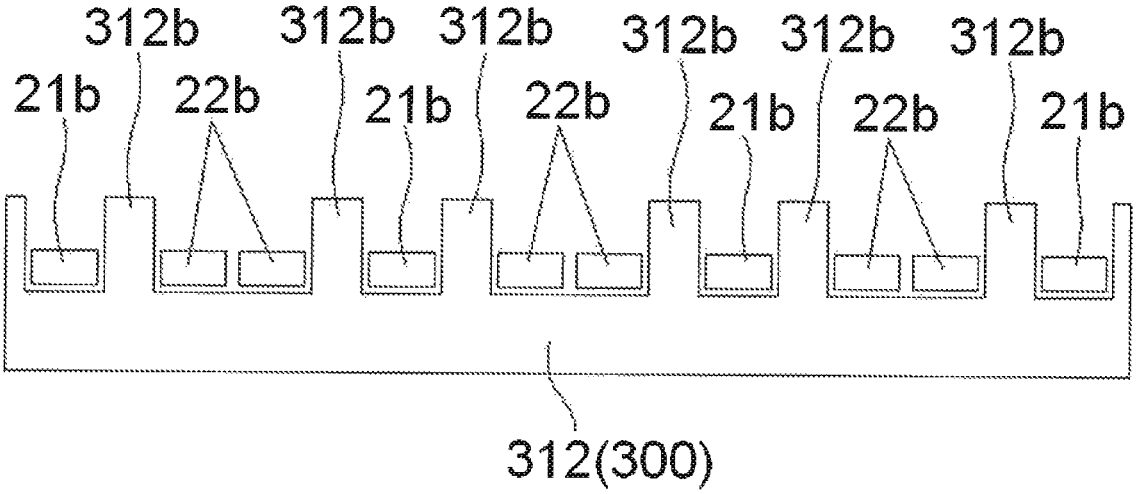
FIG. 4B is a sectional end view of the second arm positioning body and the row of second contacts.

As shown in FIGS. 2, 4A, and 4B, no insulation partition rib is disposed between the second elastic arms 22*b*, 22*b* of any two adjacent second signal contacts 22, 22; the insulation body 300 does not have any insulation partition rib for separating the second elastic arms 22*b*, 22*b* of the adjacent second signal contacts 22, 22. The insulation body 300 has a second insulation partition rib 312*b* disposed between the second elastic arm 21*b* of each second ground contact 21 and the second elastic arm 22*b* of the second signal contacts 22 adjacent to the second ground contact 21 so as to separate the second elastic arm 21*b* of each second ground contact 21 from the second elastic arm 22*b* of the second signal contacts 22 adjacent to the second ground contact 21.

As shown in FIGS. 1 and 2, each of the first ground contacts 11 includes a first solder foot 11*e* and a first connection portion 11*d* between the first solder foot 11*e* and the first fixation portion 11*c*. Each of the first signal contacts 12 includes a first solder foot 12*e* and a first connection portion 12*d* between the first solder foot 12*e* and the first fixation portion 12*c*. Similarly, each of the second ground contacts 21 includes a second solder foot 21*e* and a second connection portion 21*d* between the second solder foot 21*e* and the second fixation portion 21*c*, and each of the second signal contacts 22 includes a second solder foot 22*e* and a second connection portion 22*d* between the second solder foot 22*e* and the second fixation portion 22*c*.

The insulation body 300, as shown in FIGS. 1 and 2, includes a first fixing body 321, a second fixing body 322, a connection portion positioning body 330, a first arm positioning body 311, and a second arm positioning body 312. The first fixation portion 11*c*, 12*c* of each of the first contacts 10 is fixed to the first fixing body 321. The second fixation portion 21*c*, 22*c* of each of the second contacts 20 is fixed to the second fixing body 322. The first connection portion 11*d*, 12*d* of each of the first contacts 10 is positioned on an outer side of the connection portion positioning body 330, and the second connection portion 21*d*, 22*d* of each of the second contacts 20 is positioned on an inner side of the connection portion positioning body 330. The first elastic arm 11*b*, 12*b* of each of the first contacts 10 is positioned on the first arm positioning body 311. The second elastic arm 21*b*, 22*b* of each of the second contacts 20 is positioned on the second arm positioning body 312.

In the embodiment shown in FIGS. 1 and 2, the first fixing body 321, the second fixing body 322, the connection portion positioning body 330, the first arm positioning body 311, and the second arm positioning body 312 are assembled together to form the complete insulation body 300. In another embodiment, the insulation body 300 may also be a single molded piece that is formed on the row of first contacts 10 and the row of second contacts 20 by a molding process.

As shown in FIGS. 3A and 3B, each of the first insulation partition ribs 311*b* is formed on the first arm positioning body 311 to separate the first ground contact 11 from the first signal contacts 12 adjacent to the first ground contact 11. A row of first positioning protrusions 311*a* are formed on the first arm positioning body 311, and each of the first positioning protrusions 311*a* is located between the first contact portions 12*a* of two adjacent first signal contacts 12 to separate the two adjacent first signal contacts 12 from each other. The first contact portion 11*a* and the first elastic arm 11*b* of each of the first ground contacts 11 are positioned between two first insulation partition ribs 311*b*. The first elastic arm 12*b* of each of the first signal contacts 12 is positioned between the first positioning protrusion 311*a* and the first insulation partition rib 311*b*.

As shown in FIGS. 4A and 4B, each of the second insulation partition ribs 312*b* is formed on the second arm positioning body 312 to separate the second ground contact 21 from the second signal contacts 22 adjacent to the second ground contact 21. A row of second positioning protrusions 312*a* are formed on the second arm positioning body 312, and each of the second positioning protrusions 312*a* is located between the second contact portions 22*a* of two adjacent second signal contacts 22 to separate the two adjacent second signal contacts 22 from each other. The second contact portion 21*a* and the second elastic arm 21*b* of each of the second ground contacts 21 are positioned between two second insulation partition ribs 312*b*. The second elastic arm 22*b* of each of the second signal contacts 22 is positioned between the second positioning protrusion 312*a* and the second insulation partition rib 312*b*.

Figure 5:
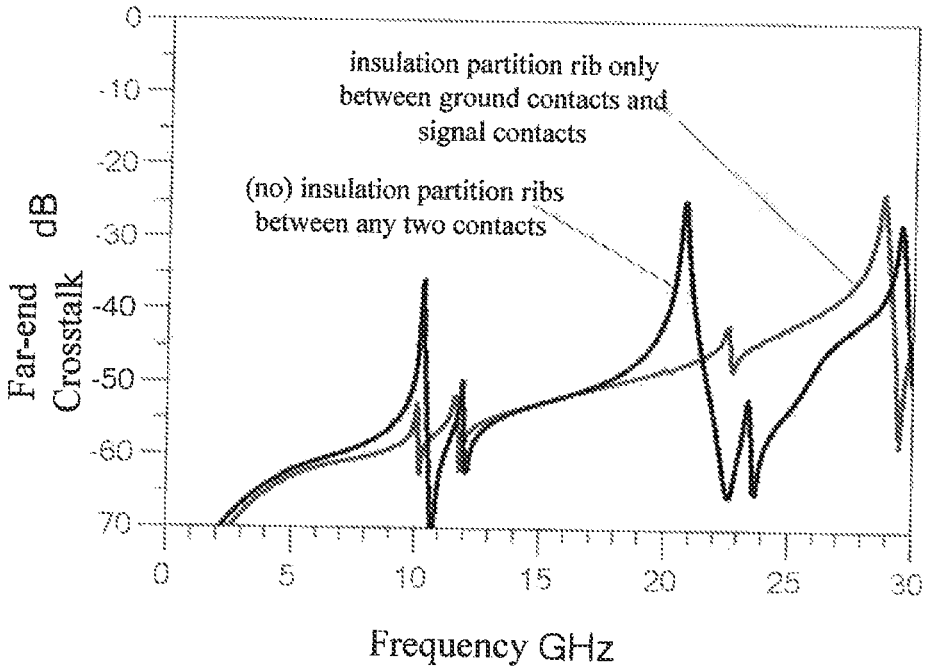
FIG. 5 is a graph of a far-end crosstalk between signal contacts and ground contacts both in the connector and in another connector in which no insulation partition ribs are disposed between any two adjacent contacts.

A far-end crosstalk between the signal contacts 12, 22 and the ground contacts 11, 21 is shown in FIG. 5 in a case where there are insulation partition ribs 311*b*, 312*b* only between each ground contact 11, 21 and the signal contact 12, 22 adjacent to the each ground contact 11, 21, as in the connector described herein, and a far-end crosstalk between the signal contacts and the ground contacts in a case where there are no insulation partition ribs between any two adjacent contacts. In a case where there are no insulation partition ribs between any two adjacent contacts, there is a large far-end crosstalk between the signal contacts and the ground contacts and the peak value (i.e., resonance) of the crosstalk is also large when an operating frequency is lower than 25 GHz. In the connector described herein, there is a small far-end crosstalk between the signal contacts 12, 22 and the ground contacts 11, 21 and the peak value (i.e., resonance) of the crosstalk is also small when an operating frequency is lower than 25 GHz. Therefore, the resonance of the connector is suppressed in the present disclosure by providing the insulation partition ribs 311*b*, 312*b* only between each ground contacts 11, 21 and the signal contacts 12, 22 adjacent to the ground contact 11, 21, improving the performance of the connector.

What is claimed is:

1. A connector comprising:

an insulation body having:

a first fixing body;

a connection portion positioning body;

a first arm positioning body; and a plurality of first insulation partition ribs; and a row of first contacts arranged on the insulation body at a first pitch, the row of first contacts includes a plurality of first ground contacts and a plurality of first signal contacts, at least two first signal contacts are disposed between any two adjacent first ground contacts, each of the first ground contacts and each of the first signal contacts has a first contact portion, a first fixation portion fixed to the first fixing body, a first elastic arm between the first contact portion and the first fixation portion and positioned on the first arm positioning body, a first solder foot, and a first connection portion between the first solder foot and the first fixation portion and positioned on a first side of the connection portion positioning body, each first insulation partition rib is disposed between the first elastic arm of each first ground contact and the first elastic arm of one first signal contact adjacent to the first ground contact, no insulation rib is disposed between the first elastic arms of any two adjacent first signal contacts.

2. The connector of claim 1, wherein a pair of first signal contacts are disposed between two adjacent first ground contacts, and the pair of first signal contacts are a pair of differential signal contacts.

3. The connector of claim 1, wherein the connector further comprises a row of second contacts disposed below the row of first contacts and arranged on the insulation body at a second pitch.

4. The connector of claim 3, wherein the second pitch is equal to the first pitch.

5. The connector of claim 3, wherein the row of second contacts includes a plurality of second ground contacts and a plurality of second signal contacts, at least two second signal contacts are disposed between two adjacent second ground contacts, each of the second ground contacts and each of the second signal contacts has a second contact portion, a second fixation portion, and a second elastic arm between the second contact portion and the second fixation portion.

6. The connector of claim 5, wherein the insulation body has a plurality of second insulation partition ribs, each second insulation partition rib is disposed between the second elastic arm of each second ground contact and the second elastic arm of one second signal contact adjacent to the second ground contact.

7. The connector of claim 6, wherein no insulation rib is disposed between the second elastic arms of any two adjacent second signal contacts.

8. The connector of claim 7, wherein a pair of second signal contacts are disposed between two adjacent second ground contacts, and the pair of second signal contacts are a pair of differential signal contacts.

9. The connector of claim 8, wherein each of the second ground contacts and each of the second signal contacts includes a second solder foot and a second connection portion between the second solder foot and the second fixation portion.

10. The connector of claim 9, wherein the insulation body is a single molded piece that is formed on the row of first contacts and the row of second contacts.

11. The connector of claim 9, wherein the insulation body further includes:

a second fixing body on which each of the second fixation portions is fixed; and a second arm positioning body on which each of the second elastic arms is positioned, wherein each of the second connection portions are positioned on a second side of the connection portion positioning body.

12. The connector of claim 11, wherein the first fixing body, the second fixing body, the connection portion positioning body, the first arm positioning body, and the second arm positioning body are assembled together to form the insulation body.

13. The connector of claim 11, wherein each of the first insulation partition ribs is formed on the first arm positioning body.

14. The connector of claim 13, wherein each of the second insulation partition ribs is formed on the second arm positioning body.

15. The connector of claim 14, wherein a row of first positioning protrusions are formed on the first arm positioning body, each of the first positioning protrusions is disposed between the first contact portions of two adjacent first signal contacts.

16. The connector of claim 15, wherein a row of second positioning protrusions are formed on the second arm positioning body, each of the second positioning protrusions is disposed between the second contact portions of two adjacent second signal contacts.

17. The connector of claim 16, wherein the first contact portion and the first elastic arm of each of the first ground contacts are positioned between two first insulation partition ribs, and the first contact portion of each of the first signal contacts is positioned between one of the first positioning protrusions and one of the first insulation partition ribs.

18. The connector of claim 17, wherein the second contact portion and the second elastic arm of each of the second ground contacts are positioned between two second insulation partition ribs, and the second contact portion of each of the second signal contacts is positioned between one of the second positioning protrusions and one of the second insulation partition ribs.

19. The connector of claim 1, wherein the insulation body comprises a plurality of first partitioning protrusions, each first positioning protrusion extending from an end of the first arm positioning body and between free ends of the first contact portions of two adjacent first signal contacts, no first positioning protrusion extending between the elastic arms of any two adjacent first signal contacts.

20. A connector comprising:

a row of first contacts, the row of first contacts including a plurality of first ground contacts and a plurality of first signal contacts, at least two first signal contacts are disposed between any two adjacent first ground contacts;

a row of second contacts disposed below the row of first contacts; and an insulation body including:

a plurality of first insulation partition ribs, each first insulation partition rib disposed between each first ground contact and one first signal contact adjacent to the first ground contact;

a first fixing body on which a first portion of each of the first contacts is fixed;

a second fixing body on which a first portion of each of the second contacts is fixed;

a connection portion positioning body, a second portion of each of the first contacts positioned on an outer side of the connection portion positioning body and a second portion of each of the second contacts positioned on an inner side of the connection portion positioning body;

a first arm positioning body on which a third portion of each of the first contacts is positioned; and a second arm positioning body on which a third portion of each of the second contacts is positioned.

* * * * *